US005957626A

United States Patent [19]

Bostwick et al.

[11] Patent Number: 5,957,626

[45] Date of Patent: Sep. 28, 1999

[54] FLUID CONTAINMENT WALL SEGMENT

[76] Inventors: Richard H. Bostwick, P.O. Box 4163, Casper, Wyo. 82604; Peter J. Schulte, 1343 S. Durbin; Gary Zitterkopf, 339 S. Jackson, both of Casper, Wyo. 82601

[21] Appl. No.: 09/037,978

[22] Filed: Mar. 9, 1998

[51] Int. Cl.[6] ..... E02D 29/02; E04B 5/04

[52] U.S. Cl. ..... 405/286; 52/591.4; 52/604; 405/284

[58] Field of Search ..... 405/284–287, 405/262, 272, 273; 52/604–612, 285.4, 285.1, 591.4, 591.1

[56] References Cited

U.S. PATENT DOCUMENTS

| | | | |
|---|---|---|---|
| 1,236,387 | 8/1917 | Moore | 52/285.1 X |
| 1,491,404 | 4/1924 | Houghton . | |
| 2,247,614 | 7/1941 | Lingerfelter | 52/604 X |
| 3,964,221 | 6/1976 | Berquist | 52/591.4 X |
| 4,920,712 | 5/1990 | Dean, Jr. . | |
| 4,936,712 | 6/1990 | Glickman . | |
| 4,956,958 | 9/1990 | Caroti | 52/605 |
| 5,030,035 | 7/1991 | Babcock . | |
| 5,114,270 | 5/1992 | Riddle . | |
| 5,282,700 | 2/1994 | Rodrique . | |
| 5,457,926 | 10/1995 | Jensen | 52/604 |
| 5,537,796 | 7/1996 | Kliethermes, Jr. . | |
| 5,551,809 | 9/1996 | Forsberg . | |
| 5,632,573 | 5/1997 | Baker . | |
| 5,688,079 | 11/1997 | Boldue et al. . | |

FOREIGN PATENT DOCUMENTS

| | | | |
|---|---|---|---|
| 511728 | 12/1953 | Belgium | 52/591.4 |
| 423667 | 1/1935 | United Kingdom | 52/591.4 |

*Primary Examiner*—Dennis L. Taylor
*Attorney, Agent, or Firm*—Laubscher & Laubscher

[57] ABSTRACT

A system for the construction of containment walls or the like using a plurality of modular blocks each having interconnectable ends for laterally mating with like blocks to form secure joints. The blocks include a plurality of corresponding ridges and channels in the block's top and bottom surfaces, respectively, for successively stacking rows of the blocks securely and properly atop of one another. The modular block system also includes specialized blocks which are capable of being stacked to form right-corners or to laterally offset an otherwise straight wall to permit contouring to suit the needs of the user.

10 Claims, 4 Drawing Sheets

FLUID CONTAINMENT WALL SEGMENT

BACKGROUND OF THE INVENTION

The present invention relates to a modular containment wall system, and more specifically, to an interlocking modular building block which permits the formation of 90° corners and other variations in otherwise straight modular block containment walls.

BRIEF DESCRIPTION OF THE RELATED ART

Currently, there are several techniques and devices known in the patented prior art for modular construction of retaining walls.

The U.S. Pat. No. 5,537,796 issued to Kliethermes, for example, discloses a retaining wall block and system. The construction block has first and second pins in a top surface to be received in corresponding first and second slots in the bottom surface of an adjacent block to form an interlocking connection. While pin and slot connections may be of sufficient strength to hold material such as soil, such interconnections do not provide the necessary strength and tight fitting seal to retain a fluid, such as water.

U.S. Pat. No. 4,920,712 issued to Dean discloses a concrete block retaining wall and method of construction therefor. Walls constructed according to the method of this patent include special clips used to secure the individual blocks together. While the blocks provide for the construction of curved walls, they do not provide for the construction of vertically interlocking corners.

U.S. Pat. No. 4,936,712 issued to Glickman discloses a retaining wall system utilizing specially formed upwardly convex shaped blocks containing a plurality of longitudinal ridges. The shape and ridges enable the blocks to be stacked in offset overlying courses rather than directly vertically atop one another. U.S. Pat. No. 5,030,035 issued to Babcock discloses an earth retaining system formed of a plurality of relatively complex preformed blocks. While these building blocks operate satisfactorily for their intended purpose, they are unsuitable for use as corner structures.

The present invention was developed in order to overcome these and other drawbacks of the prior devices for modular block construction of retaining walls.

SUMMARY OF THE INVENTION

Accordingly, a primary object of the present invention is to provide an improved containment wall construction block which interlocks with other similar construction blocks to form a containment wall or the like. The block has a generally rectangular body with complimentary interlocking step and overhanging portions at opposite ends thereof for connecting the ends of laterally adjacent blocks. The block further includes a plurality of ridges and channels integrally formed on the top and bottom surfaces to form secure joints between blocks when they are stacked vertically atop one another.

Another object of the invention is to provide an improved containment wall construction block wherein the interlocking step and overhanging portions contain complimentary inclined surfaces to further secure the blocks together.

It is another object of the present invention to provide an improved containment wall construction block wherein the interlocking step and overhanging portions contain a connector bore for receiving a connector member for further securing laterally mated blocks.

Another object of the invention is to provide a modular block that can be used in conjunction with straight blocks to laterally offset an otherwise straight wall to assist in contouring the wall to the specific design needs of a user.

Still another object of the present invention is to provide an improved wall system which includes the capability of forming right angled corners using a specialized modular block.

BRIEF DESCRIPTION OF THE DRAWINGS

Other objects and advantages of the invention will become apparent from a study of the following specification when viewed in light of the accompanying drawings, in which.

DETAILED DESCRIPTION

Figure 1:
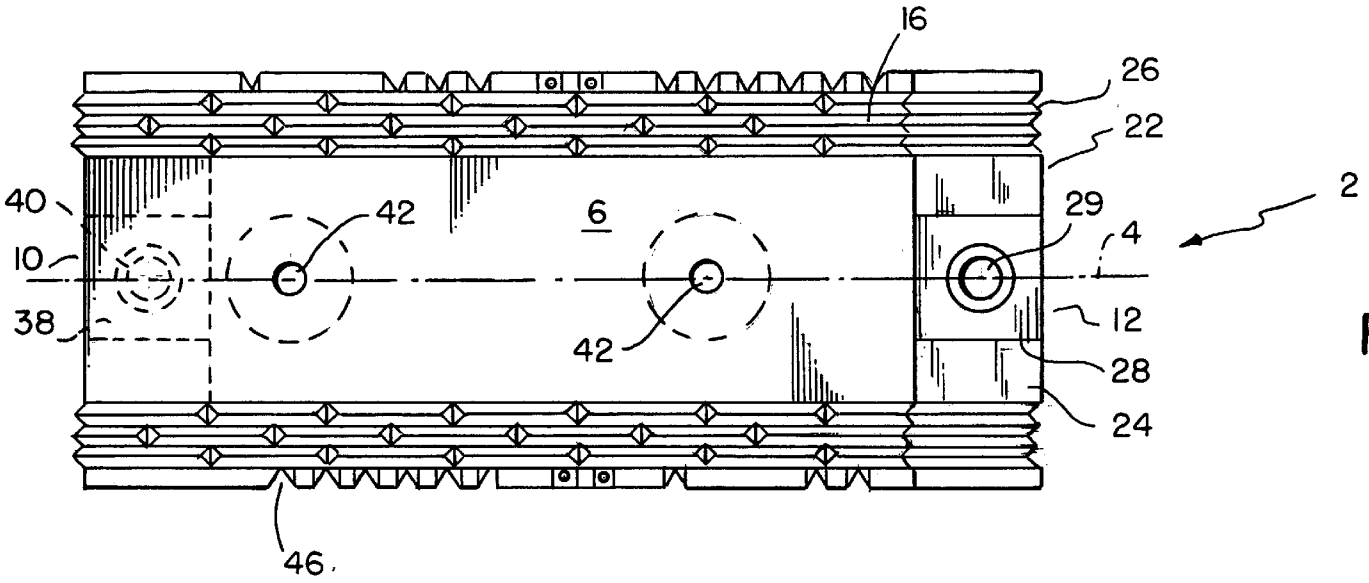
FIGS. 1–3 are top, side, and end plan views, respectively, of a straight block according to the invention.
Figure 3:
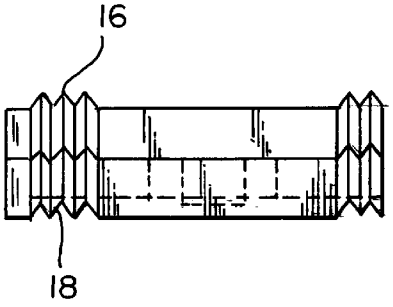
Figure 2:
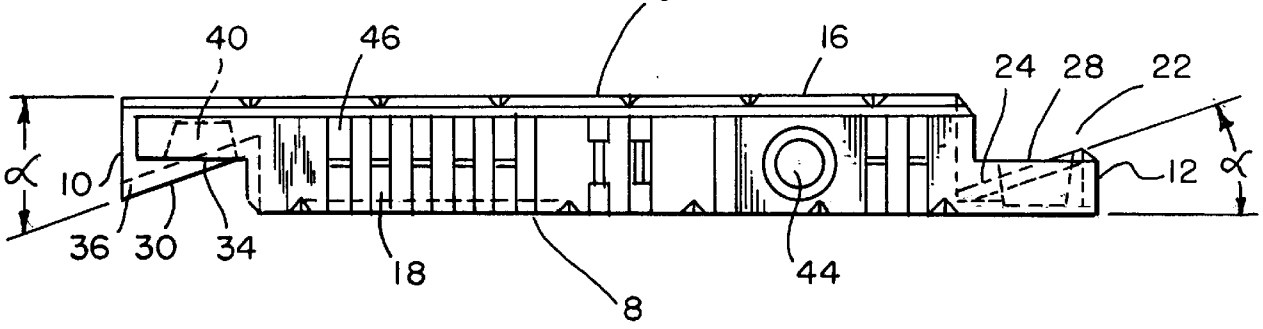

Referring to FIGS. 1–3, there is shown a straight modular block 2 having a generally rectangular configuration and a longitudinal axis 4. The block has top 6 and bottom 8 surfaces and overhanging 10 and step 12 portions at opposite ends thereof. Extending parallel to the longitudinal axis 4 and running the length of the block 2 are a series of ridges 16. The ridges 16 are formed in the top surface 6 of the blocks 2 and have a triangular cross-section. Preferably, an equal number of ridges 16 are positioned on both sides and equidistant from the longitudinal axis 4 to produce a block which will stack evenly and maintain a level position while under load, as will be developed below.

The block bottom surface 8 contains a plurality of channels, each having a triangular cross-section and extending the length of the block 2. The channels 18 are molded within the bottom surface and are of equal number and in corresponding locations in order to receive the ridges 16 of the upper surface 6 of a separate block 2 when stacked on top of one another. The ridges 16 and channels 18 provide additional structural strength to each modular block 2. They also ensure a proper fitting and alignment between the stacked blocks along with increased resistance to any lateral displacement once the blocks are stacked, thereby increasing the overall rigidity of a containment wall structure.

The block step end 12 is defined by cutting away a portion of the top surface across the width of the rectangular block 2. An interlocking surface 22 of the step end receives an overhanging end 10 of an adjacent block. The interlocking surface 22 includes a portion 24 which is inwardly declined at an angle $\alpha$ with respect to the bottom surface and has ridges 26 of triangular cross-section extending parallel to longitudinal axis 4 and integrally molded thereon. The interlocking surface 22 also contains a connector bearing surface 28 positioned symmetrically between the top 6 and bottom 8 surfaces along longitudinal axis 4. The connector bearing surface 28 contains a connector bore 29 therein which extends through the block 2 towards the bottom surface 8.

The block overhanging end 10 is defined by cutting away a portion of the bottom surface 8 and has an interlocking surface 30 at the bottom thereof. The interlocking surface 30 includes a portion 34 which is inwardly declined at angle $\alpha$ with respect to the top surface 6 and has channels 36 of triangular cross-section therein. Interlocking surface 30 also contains a connector bearing surface 38 positioned symmetrically between the top 6 and bottom 8 surfaces and along longitudinal axis 4. Connector bearing surface 38 contains a connector bore 40 therein which extends through the block 2 towards the top surface 6. Therefore, straight block 2 has a step end 12 and an overhanging end 10 with interlocking surfaces 22, 30, respectively, which are rotated 180° from each other along the same longitudinal axis 4.

Figure 4:
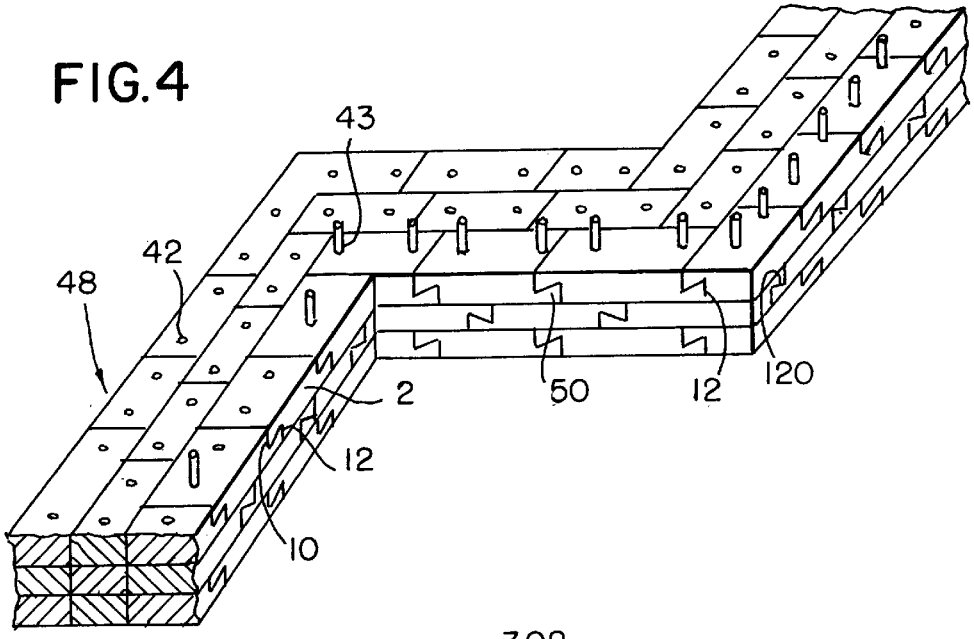
FIG. 4 is a perspective view of a containment wall constructed of the straight blocks.

Referring now to FIG. 4, a block 2 is connected with similar blocks by positioning the overhanging end 10 of the block over the step end 12 of another block, thereby causing the interlocking surfaces of both ends to mate, creating a secure joint between blocks having flush top 6 and bottom 8 surfaces. The flush surfaces permit further rows of blocks 2 to be successively stacked on top of one another to construct a containment wall 48.

For additional structural integrity of the containment wall, the blocks 2 contain vertical alignment bores 42 positioned along longitudinal axis 4. It is important to note that when successive layers of interlocked blocks 4 are stacked on top of one another, alignment bores 42 of the block segments of each layer of the containment wall are aligned so that a reinforcing shaft 43 may be passed vertically down through all layers of the wall and secured into the earth beneath the wall. In this manner, the alignment bores 42 not only increase the strength of the joints of the block segments to each other, they also ensure that the constructed containment wall maintains proper vertical alignment despite external loads acting on the wall.

Alignment of the alignment bores 42 results in an overlap between rows of the blocks which ensures that joints 50 between laterally adjacent blocks are staggered vertically within the wall 48. The effect of this alignment is that the blocks are stacked directly above or below a joint 50 having half of the block on either side of the joint. Staggering the blocks in such a manner eliminates weak points in the wall 48 which are more likely to give way under heavy loads.

Figure 5:
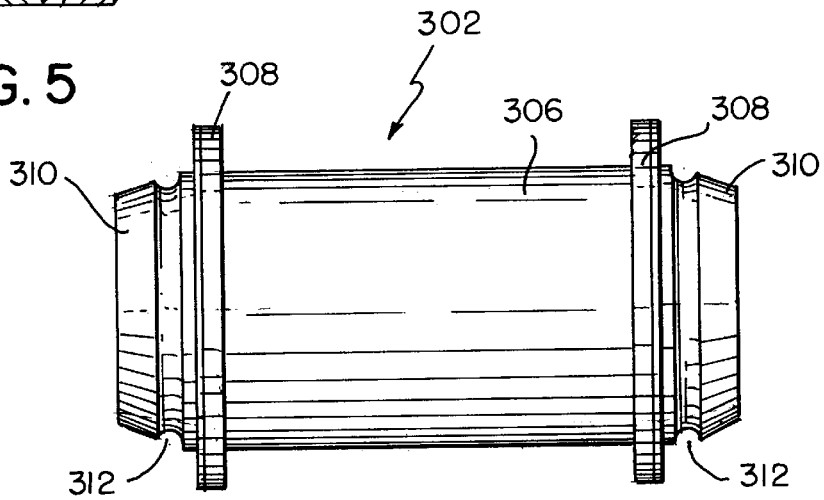
FIGS. 5 and 6 are side plan views of the connector and fastener, respectively, for connecting adjoining blocks of FIG. 1.
Figure 6:
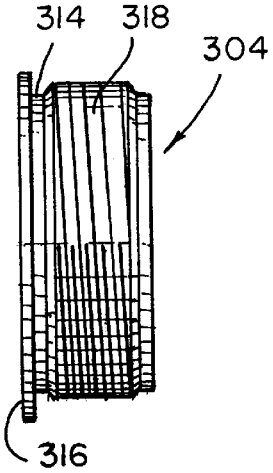
Figure 7:
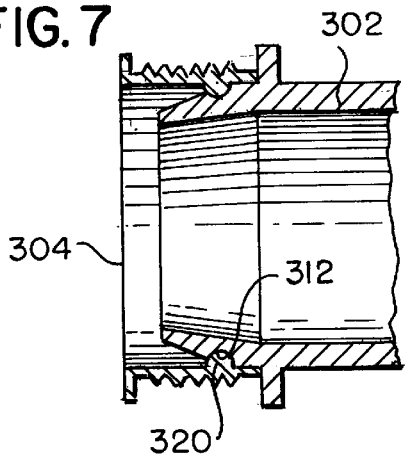
FIG. 7 is a side plan view showing the connection between the connector and fastener of FIGS. 5 and 6.

To increase the strength of the joint between blocks, a connector 302 and a fastener 304, as shown in FIGS. 5–7, is employed. The connector is constructed of a resilient material and has an elongated cylindrical body 306 with annular flanges 308 adjacent each end. The body 306 terminates in outwardly tapering conical portions 310 each having an annular grove 312 inscribed therein along an outer surface. Each end of the connector 302 is designed to be received within a fastener 304 which is mounted within the connector bore 29, 40 of the step and overhanging ends respectively. The fastener has a hollow cylindrical body of slightly larger diameter than the connector 302 on which a flanged portion 316 is located on one end and an outwardly threaded portion 318 is arranged on the other. Internally, the fastener 304 contains a raised annular rib 320. As shown in FIG. 7, when a conical end 310 of the connector is inserted into the fastener 304, the rib 320 is received by groove 312 which holds the connector 302 in locking engagement within the fastener 304 which in turn holds together the connector bores 29, 40, and therefore the respective ends of adjacent blocks.

The block 2 is generally hollow and includes a resealable cap 44 for filling the segment with material, such as water, to increase the overall weight and strength of the block. The block may later be emptied for ease of handling and storage.

For additional structural integrity, vertical channels 46 may be molded within the side surfaces of the blocks 2. As shown in FIG. 2, channels 46 extend from top 6 to bottom 8 surfaces.

Figure 8:
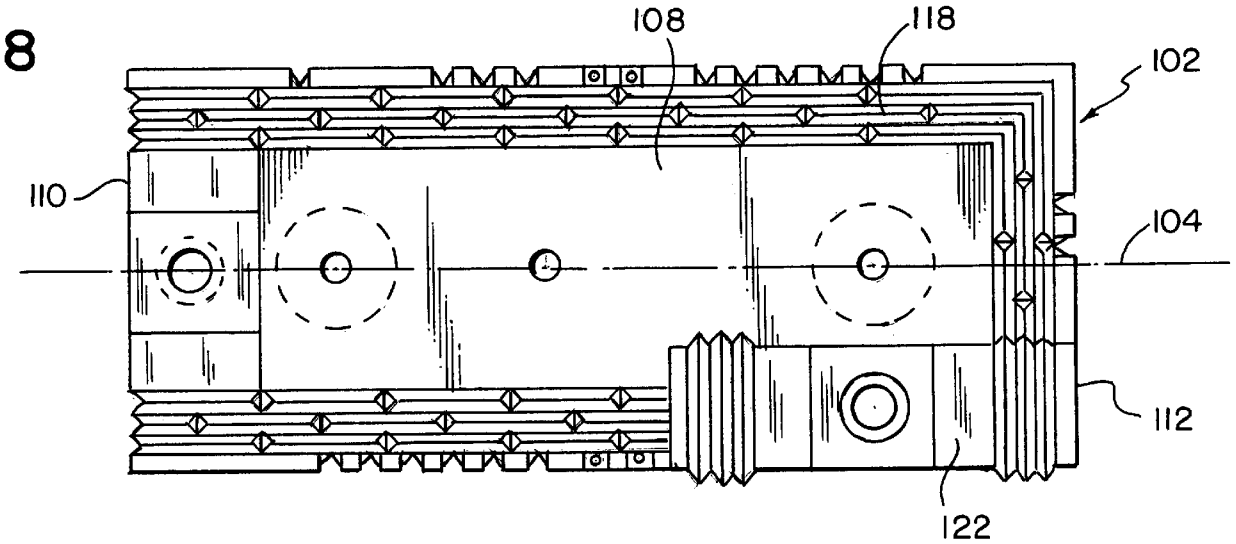
FIGS. 8–10 are top, side, and end plan views, respectively, of a 90° block according to the invention.
Figure 10:
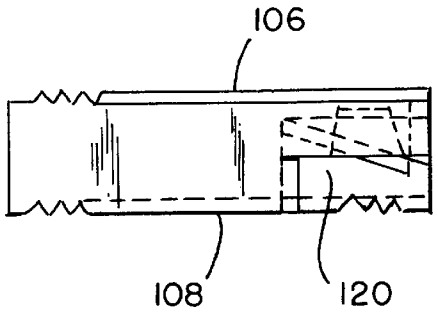
Figure 9:
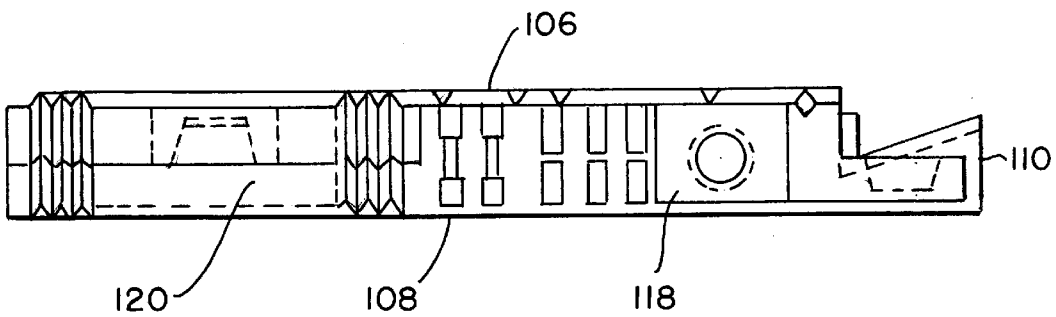

Referring now to FIGS. 8–10, there is shown a 90° modular block 102 having top 106 and bottom 108 surfaces. The 90° block 102 further includes step 110 and overhanging 112 ends located adjacent opposite ends of longitudinal axis 104. Within the top surface 106 and extending parallel to and along either side of longitudinal axis 104 there are ridges of triangular cross-section. Adjacent the overhanging end 112, additional ridges in the top surface extend perpendicular to longitudinal axis 104. The bottom surface contains a corresponding pattern of channels 118 for receiving the ridges of a segment 102 on which it is stacked upon.

The step end 110 is cut away from top surface 106 which extends across the width of the 90° block 102. The step end 110 is of identical design to the step end 12 of straight block 2, shown in FIGS. 1–3.

On the overhanging end 112 of the 90° block 102, the bottom surface 108 is cut away equal in length to the width of the 90° segment block 102 and is positioned parallel to longitudinal axis 104. An interlocking surface 122 identical to interlocking surface 30 is provided so that it can receive in locking engagement the step end 12 of a like modular block.

Refering back to FIG. 4, it can be seen that in operation the 90° block 102 is used in conjunction with straight blocks 2 for the construction of corners in the containment wall 48. By placing a straight segment block's step end 12 into a 90° block's overhanging end recess 120, the segments will mate to form a 90° joint having flush top and bottom surfaces so that successive layers of similarly configured blocks may be stacked on top to form a corner of desired height.

Figure 11:
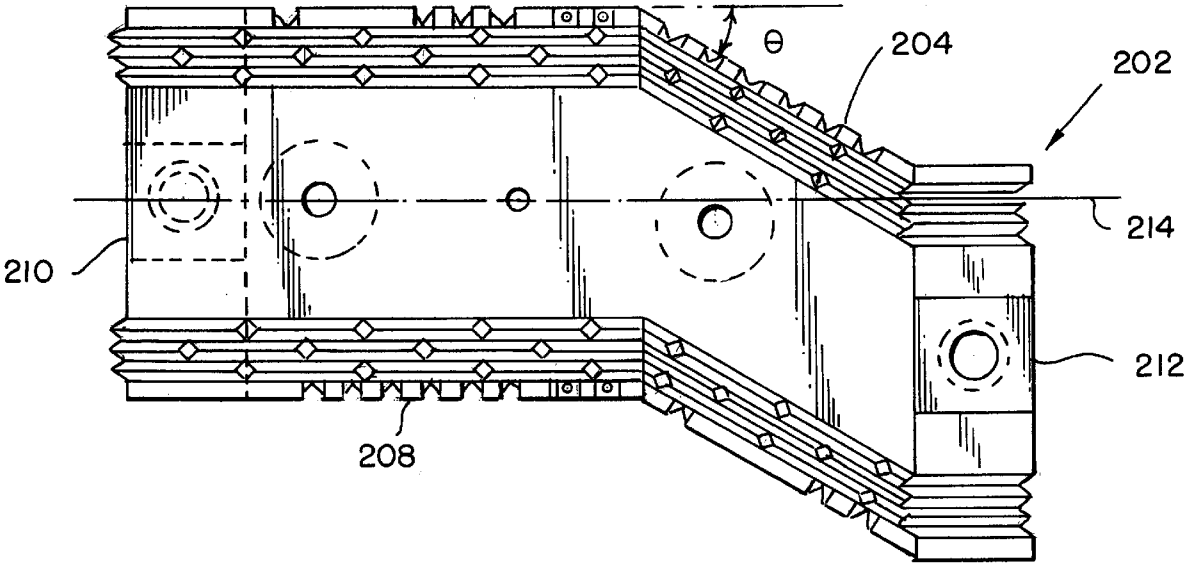
FIG. 11 is a top plan view of an off-setting block according to the invention.
Figure 13:
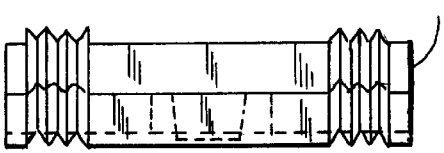
FIG. 13 is an end plan view of the step end of the block of FIG. 11.
Figure 12:
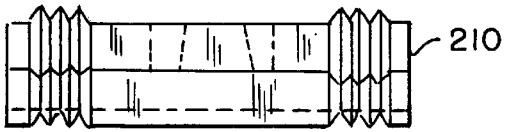
FIG. 12 is an end plan view of the overhanging end of the block of FIG. 11.

Referring now to FIGS. 11–13, there is shown an angled modular block 202 having step 210 and overhanging 212 ends at opposite ends thereof. Located between the ends, there is a straight portion 208 and an angled portion 204 which laterally offsets the overhanging end 212 from longitudinal axis 214. As shown in this embodiment, the offsetting portion 204 shifts the step end 212 over at a specified angle $\phi$ necessary for the specialized needs of the design of a contoured wall.

In operation, an angled block 202 may be utilized with straight blocks 2 by mating respective step and overhanging ends of the blocks together to form locking joints. The angled blocks 202 are specially advantageous when only slight contouring of the containment wall is necessary. In other circumstances, a 90° block could be employed.

While in accordance with the provisions of the Patent Statute, the preferred forms and embodiments of the invention have been illustrated and described, it will be apparent to those of ordinary skill in the art that various changes and modifications may be made without deviating from the inventive concepts set forth above.

What is claimed is:

1. Apparatus for the construction of retaining walls and the like, comprising (a) a block having top and bottom surfaces, and overhanging and step portions located at opposite ends thereof;

(b) said bottom surface containing a plurality of channels each having a triangular cross-section, said channels extending along the length of said block;

(c) said top surface including a plurality of ridges each having a triangular cross-section and extending said length in spaced superimposed relation above said channels, whereby when an upper block is stacked on top of a lower block, said ridges of said lower block are received in said channels of said upper block to assure proper positioning and resist lateral displacement; and (d) means arranged within said step and overhanging portions for interlocking said overhanging portion of one block with said step portion of an adjacent block.

2. Apparatus as defined in claim 1, wherein said overhanging portion has a lower surface arranged at an angle relative to said top surface and said step portion has an upper surface arranged at said angle relative to said bottom surface, whereby said overhanging lower surface of a first block and said step upper surface of a laterally adjacent block mate in interlocking fashion to secure said blocks together.

3. Apparatus as defined in claim 2, wherein said overhanging lower and step upper surfaces contain complimentary groves and ridges to further interlock said laterally adjacent blocks.

4. Apparatus as defined in claim 3, wherein said overhanging lower and step upper surfaces each contain a connector bearing surface symmetrically positioned between said upper and lower surfaces and parallel thereto, each of said connector bearing surfaces having a connector bore therein adapted for alignment when said laterally adjacent blocks are in mating relation, and further including a connector member arranged within said connector bores to further connect said laterally adjacent blocks.

5. Apparatus as defined in claim 2, wherein said block is a straight block.

6. Apparatus as defined in claim 2, wherein said block further includes two spaced parallel side surfaces, said step portion arranged on one end of said block and said overhanging portion arranged on one of said side surfaces adjacent an opposite end of said block to define a 90 degree block, whereby said step portion of said block may be orthogonally mated with said overhanging portion of said 90 degree block to form a corner.

7. Apparatus as defined in claim 2, wherein said block further comprises a straight portion and an angular portion located intermediate said step and overhanging portions for laterally displacing said portions away from alignment with each other.

8. Apparatus as defined in claim 2, wherein said upper and lower surfaces contain a plurality of alignment bores which pass through said block, whereby reinforcing shafts may be positioned through said alignment bores of stacked blocks to strengthen a retaining wall formed of said blocks.

9. Apparatus as defined in claim 2, wherein said block further comprises two parallel spaced side surfaces each having a plurality of vertical channels formed therein extending between said top and bottom surfaces.

10. Apparatus as defined in claim 2, and further including a resealable opening for permitting said block to be filled with material.

* * * * *